US006199210B1

(12) United States Patent
Feldman

(10) Patent No.: US 6,199,210 B1
(45) Date of Patent: Mar. 13, 2001

(54) GARMENT DECORATION

(75) Inventor: Michael S. Feldman, Highland Park, IL (US)

(73) Assignee: Logan Knitting Mills, Inc., Elmwood Park, IL (US)

( * ) Notice: Subject to any disclaimer, the term of this patent is extended or adjusted under 35 U.S.C. 154(b) by 0 days.

(21) Appl. No.: 09/628,070

(22) Filed: Jul. 28, 2000

(51) Int. Cl.[7] ..... A41D 3/00

(52) U.S. Cl. ..... 2/69; 2/108; 2/244; 2/246; 2/272

(58) Field of Search ..... 2/69, 115, 227, 2/228, 85, 93, 94, 95, 88, 244, 246, 272; 40/586

(56) References Cited

U.S. PATENT DOCUMENTS 2,919,443 * 1/1960 Kashiyama ..... 2/108
3,193,842 * 7/1965 Bell ..... 2/108
4,608,715 * 9/1986 Miller et al. ..... 2/1
5,010,592 * 4/1991 Skiles, Jr. ..... 2/93
5,570,473 * 11/1996 Andries ..... 2/93

* cited by examiner

*Primary Examiner*—Gloria M. Hale
(74) *Attorney, Agent, or Firm*—Rockey, Milnamow & Katz, Ltd.

(57) ABSTRACT

A garment comprising an outer layer, which has an outer surface and an inner surface, and an inner layer, which is attached to the outer layer, has a slit defined by two opposite margins. The garment comprises a fastener, such as a zipper or a hook-and-loop fastener, which is manipulatable to unfasten the opposite margins from each other and to refasten the opposite margins to each other. The slit provides access to the inner surface of the outer layer, when the opposite margins are unfastened from each other, so that a decoration can be stitched onto the outer surface of the outer layer, through the inner surface of the outer layer, without stitching through the inner layer.

6 Claims, 2 Drawing Sheets

GARMENT DECORATION

TECHNICAL FIELD OF THE INVENTION

This invention pertains to a garment, such as a jacket or a shirt, which has an outer layer and an inner layer, wherein the inner layer has a novel construction enabling a decoration, such as embroidery or a patch, to be stitched onto the outer layer only, as by a machine, after the inner layer has been attached to the outer layer, as by stitching.

BACKGROUND OF THE INVENTION

Commonly, a garment worker is presented with a garment having an outer layer and an inner layer, which is attached to the outer layer by stitching or otherwise, and is called upon to stitch a decoration, such as embroidery or a patch, onto an outer surface of the outer layer without stitching through the inner layer. It may be then necessary for the garment worker to open stitching so as to detach the inner layer from the outer layer, at least partially, so that the garment worker can use a machine to stitch the decoration through the outer layer, but not through the inner layer, whereupon the garment worker may have to reattach the inner layer to the outer layer.

SUMMARY OF THE INVENTION

This invention provides a garment comprising an outer layer and an inner layer, which is affixed to the outer layer, as by stitching. The inner layer has a novel slit, which is defined by two opposite margins. Further, the garment comprises a fastener of a type that is manipulatable to enable the opposite margins to be unfastened from each other and to be refastened to each other. The slit provides access to the inner surface of the outer layer, when the opposite margins are unfastened from each other, so that a decoration can be stitched onto the outer surface of the outer layer, through the inner surface of then outer layer, but not through the inner layer, without stitching through the inner layer. In one contemplated embodiment, the fastener comprises a zipper. In another contemplated embodiment, the fastener comprises a hook-and-loop fastener.

This invention enables a garment worker to manipulate the fastener so as to unfasten the opposite margins from each other, to separate the opposite margins, to stitch a decoration onto an outer surface of the outer layer, through an inner surface of the outer layer, but not through the inner layer. After the decoration has been stitched onto the outer surface of the outer layer, the garment worker can refasten the opposite margins to each other by the fastener.

DETAILED DESCRIPTION OF THE ILLUSTRATED EMBODIMENTS

Figure 1:
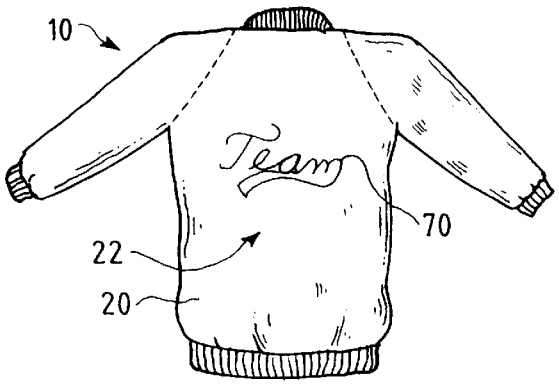
FIG. 1 is an elevational view of one contemplated embodiment of a garment, as exemplified by a jacket, which has embroidery stitched onto an outer surface of an outer layer, at a back portion of the garment, in a manner contemplated by this invention, the garment being seen from a back vantage and the garment being closed.

As shown in the drawings, a garment 10, as exemplified by a jacket, has an outer layer 20, which has an outer surface 22 and an inner surface 24, and an inner layer 30, which is attached to the outer layer 20, as by stitching. Each of the outer and inner layers 20, 30, may comprise plural sub-layers. As provided by this invention, the inner layer 30 has an elongate, generally horizontal slit 40, which is defined by two opposite margins, namely an upper margin 42 and a lower margin 44, and which extends from side to side along a front portion 46 of the jacket 10. The respective margins 42, 44, can be bound, as by stitching, to prevent unraveling. The garment 10 comprises a fastener, which is adapted to fasten the opposite margins 42, 44, to each other.

Figure 3:
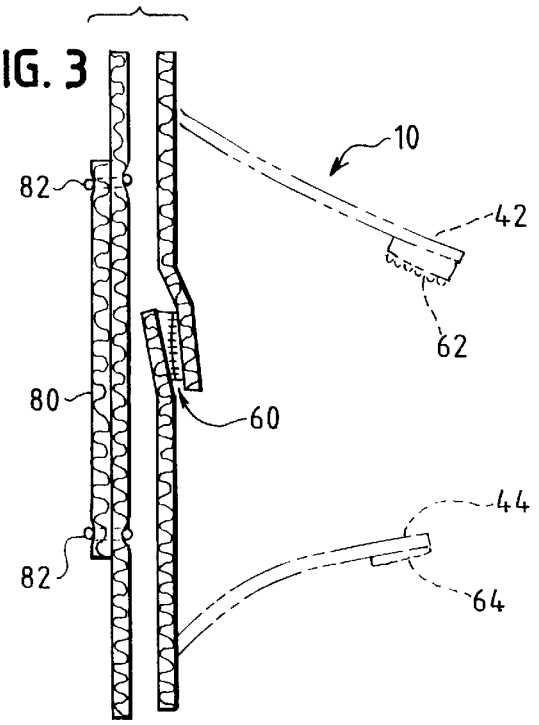
FIG. 3 is a fragmentary, sectional view taken along line 3—3 of FIG. 2, in a direction indicated by arrows, but modified to shown a hook-and-loop fastener, rather than the zipper shown in FIG. 2, and to show a patch, rather than embroidery shown in FIG. 2.
Figure 2:
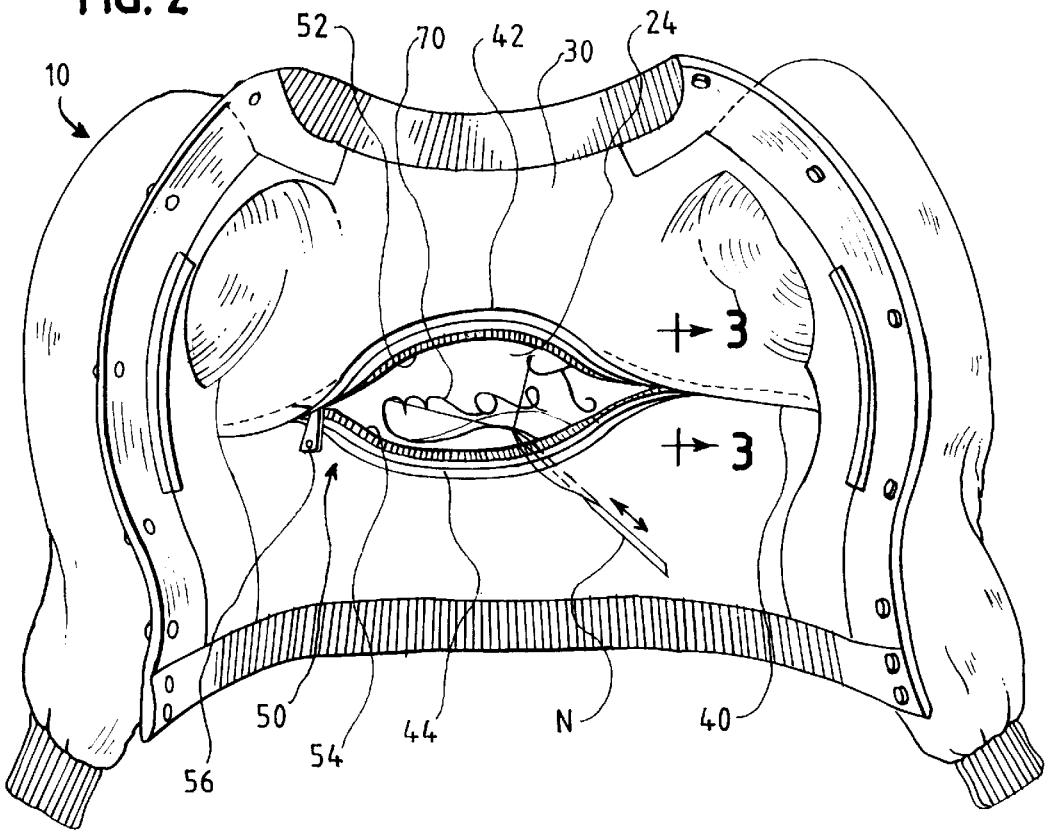
FIG. 2, on a larger scale, is an elevational view of the garment, as seen from a front vantage, the garment being opened to show an inner layer having a generally horizontal slit, which extends along a back portion of the garment and which is defined by two opposite margins having a zipper, the zipper being opened.

In one embodiment contemplated by this invention, as shown in FIG. 2, the fastener is a zipper 50, which has an upper track 52 stitched to and along the upper margin 42, which has a lower track 54 stitched along the lower margin 44, and which has a pull tab 56. Such a zipper is conventional and is available commercially under various trademarks including the trademark TALON. In another contemplated embodiment, as shown in FIG. 3, the fastener is a hook-and-loop fastener 60, which has a loop-faced ribbon 62 stitched to and along the upper margin 42 and which has a hook-faced ribbon 64 stitched to and along the lower margin 44. The respective ribbons 62, 64, can be instead stitched to and along the lower and upper margins 44, 42, respectively. Such a hook-and-loop fastener is conventional and is available commercially under the trademark VELCRO. In alternative but less preferred embodiments (not shown) the fastener may comprise a series of buttons coacting with button holes, a series of snap fasteners, a series of hook-and-eye fasteners, or other suitable fasteners.

This invention enables a garment worker to manipulate the fastener so as to unfasten the opposite margins 42, 44, from each other, to separate the opposite margins 42, 44, to stitch a decoration onto the outer surface 22 of the outer layer 20, at the front portion 46 of the garment 10, through the inner surface 24 of the outer layer 20 but not through the inner layer 30. As shown in FIGS. 1 and 2, the decoration is exemplified by embroidery 70. In FIG. 2, an exemplary needle N of an embroidering machine is shown. As shown in FIG. 3, the decoration is exemplified by a patch 80. In FIG. 3, some stitches 82 used to stitch the patch 80 onto the outer surface 22 of the outer layer 20 are shown. After the decoration has been stitched thereonto, the garment worker can refasten the opposite margins 42, 44, to each other by the fastener.

Figure 4:
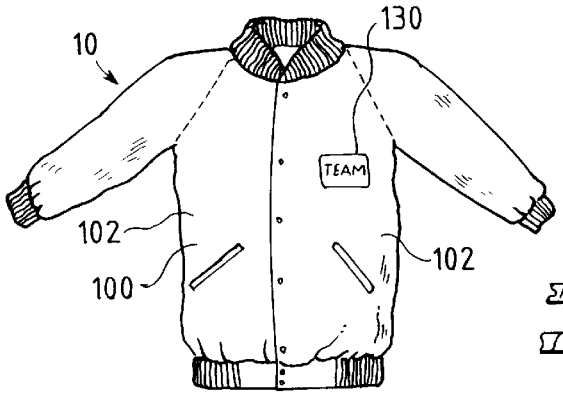
FIG. 4, on the scale of FIG. 1, is an elevational view of the garment, which has a patch stitched onto one side of a front portion of the garment, as seen from a front vantage, the garment being closed.
Figure 6:
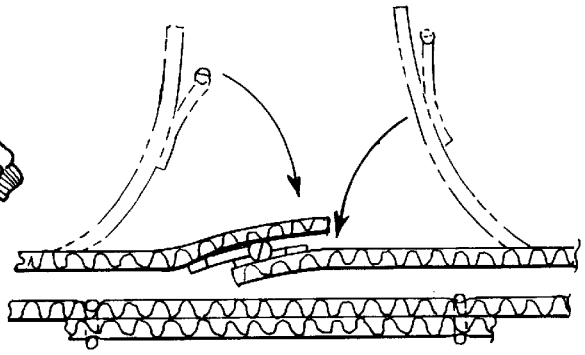
FIG. 6 is a sectional view taken along line 6—6 of FIG. 5, in a direction indicated by arrows.
Figure 5:
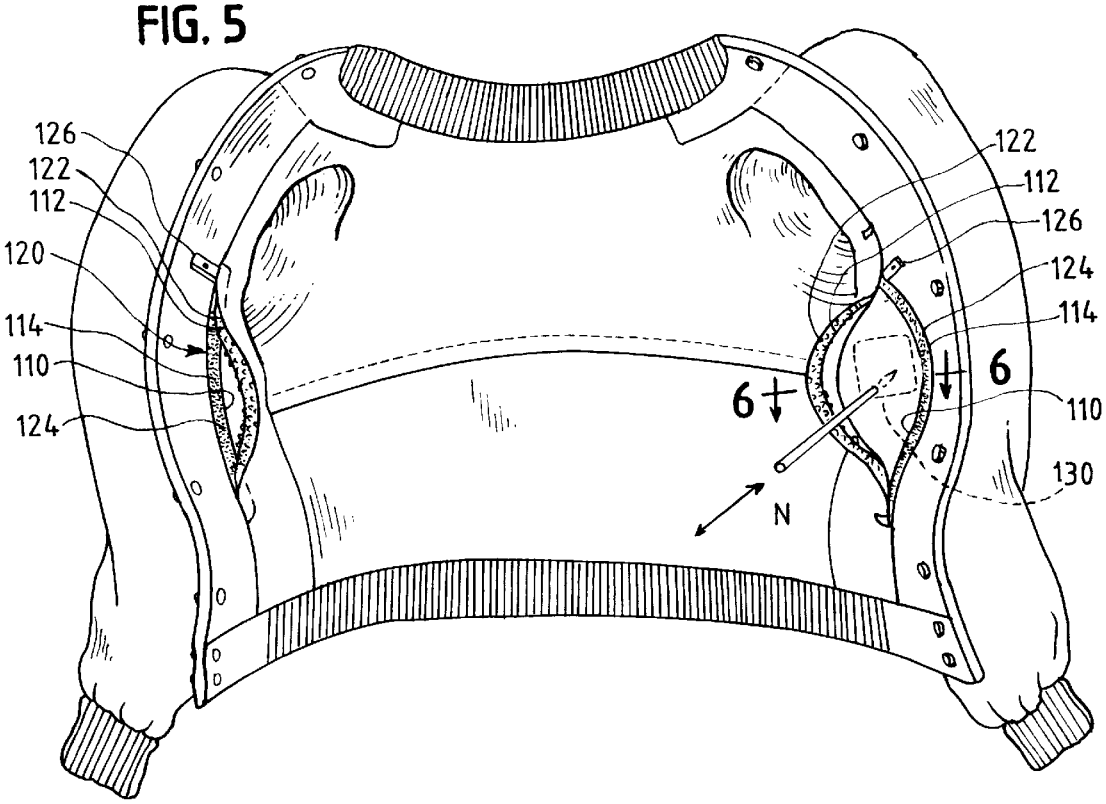
FIG. 5, on a larger scale, is an elevational view of the garment, as seen from a front vantage, the garment being opened to show the inner layer having two generally vertical slits, each of which extends along one side of the front portion of the garment and each of which is defined by two opposite margins having a zipper, the zipper being opened.

As shown in FIGS. 4, 5, and 6, a front portion 100 of the garment 10 has on each of its left and right sides 102, an elongate, generally vertical slit 110, which is defined by two opposite margins, namely a front margin 112 and a back margin 114. Moreover, at each slit 110, the garment 10 has a fastener, which is adapted to fasten the opposite margins 112, 114, to each other.

As shown in FIGS. 4, 5, and 6, each fastener associated with one of the slits 120 is a zipper 120, which has a front track 122 stitched to and along the front margin 112 of the associated slit 110, which has a back track 124 stitched to and along the back margin 114 of the associated slit 120, and which has a pull tab 126. Alternatively, each fastener associated with one of the slits 120 may comprise a hook-and-loop fastener, as described above, a series of buttons coacting with button holes, a series of snap fasteners, a series of hook-and-eye fasteners, or other suitable fasteners.

This invention enables a garment worker to manipulate the fastener so as to unfasten the opposite margins 112, 114, from each other, to separate the opposite margins 112, 114, to stitch a decoration onto the outer surface 22 of the outer layer 20, at one side 102 of the front portion 100 of the garment 10, through the inner surface 24 of the outer layer 20 but not through the inner layer 30. As shown in FIGS. 4, 5, and 6, the decoration is exemplified by a patch 130. In FIG. 5, an exemplary needle N of a sewing machine is shown. After the decoration has been stitched thereonto, the garment worker can refasten the opposite margins 112, 114, to each other by the fastener.

What is claim is:

1. A garment comprising an outer layer, which has an outer surface and an inner surface; an inner layer, which is attached to the outer layer and which has a slit defined by two opposite margins; and a fastener manipulatable to unfasten the opposite margins from each other and to refasten the opposite margins to each other; the slit providing access to the inner surface of the outer layer, when the opposite margins are unfastened from each other, so that, in an intended use, a decoration can be stitched onto the outer surface of the outer layer, through the inner surface of the outer layer, without stitching through the inner layer.

2. The garment of claim 1 wherein the garment comprises a decoration stitched onto the outer surface of the outer layer, through the inner surface of the outer layer, but not through the inner layer.

3. The garment of claim 2 wherein the decoration comprises embroidery stitched onto the outer surface of the outer layer, through the inner surface of the outer layer, but not through the inner layer.

4. The garment of claim 3 wherein the decoration comprises a patch stitched onto the outer surface of the outer layer, through the inner surface of the outer layer, but not through the inner layer.

5. The garment of claim 1, 2, 3, or 4 wherein the fastener comprises a zipper.

6. The garment of claim 1, 2, 3, or 4 wherein the fastener comprises a hook-and-loop fastener.

* * * * *